US005431470A

United States Patent [19]

Magerl et al.

[11] Patent Number: 5,431,470

[45] Date of Patent: Jul. 11, 1995

[54] MACHINERY LIFT ASSEMBLY

[75] Inventors: Donald L. Magerl, Olathe, Kans.; John K. Woodward, Cowgill, Mo.; David J. Bryan, Gardner, Kans.

[73] Assignee: The Atchison, Topeka and Santa Fe Railway Company, Schaumburg, Ill.

[21] Appl. No.: 239,681

[22] Filed: May 6, 1994

[51] Int. Cl.[6] ..... B66C 13/08

[52] U.S. Cl. ..... 294/67.2; 294/67.5

[58] Field of Search ..... 294/63.1, 67.1–67.22, 294/67.5, 81.1, 81.3, 81.4, 86.41, 93, 103.2, 122–124

[56] References Cited

U.S. PATENT DOCUMENTS

| | | | |
|---|---|---|---|
| 3,709,547 | 1/1973 | Nutter | 294/67.21 |
| 3,843,185 | 10/1974 | James et al. | 294/67.21 |
| 3,998,488 | 12/1976 | Durgan | 294/67.21 |
| 4,154,470 | 5/1979 | Dalglish | 294/86.41 X |
| 4,251,098 | 2/1981 | Belinsky | 294/67.21 |
| 4,950,012 | 8/1990 | Jones | 294/67.5 X |

FOREIGN PATENT DOCUMENTS

| | | | |
|---|---|---|---|
| 3333108 | 3/1985 | Germany | 294/67.5 |
| 2063210 | 6/1981 | United Kingdom | 294/81.4 |
| 800099 | 1/1981 | U.S.S.R. | 294/81.4 |
| 1017648 | 5/1983 | U.S.S.R. | 294/81.3 |
| 1184793 | 10/1985 | U.S.S.R. | 294/67.21 |
| 1409570 | 7/1988 | U.S.S.R. | 294/81.4 |

*Primary Examiner*—Johnny D. Cherry

[57] ABSTRACT

A machinery lift assembly includes an L-shaped tubular support member having a first leg thereof connected to a beam of a pivot joint. The pivot joint defines first and second cantilevered portions of the beam. A hydraulic cylinder is pivotably connected between the first cantilevered beam portion and the first leg of the support member to cause the beam to pivot relative to the support member upon activation of the cylinder. The second cantilevered beam portion is fitted at its end with a device for attachment to a machinery component. The beam and attachment device may thereby be inserted into confined spaces to remove or replace machinery components installed therein.

8 Claims, 2 Drawing Sheets

MACHINERY LIFT ASSEMBLY

BACKGROUND OF THE INVENTION

1. Field of the Invention

The present invention relates generally to a lift assembly for lifting machinery components and it relates more particularly to a lift assembly capable of flexible movement for reaching into enclosed or constricted spaces to enable and facilitate access to and maintenance, repair, removal or installation of machinery components therein.

2. Description of the Prior Art

The construction of heavy equipment such as railroad locomotives, for example, is such that many components are installed in confined spaces. Specifically in a locomotive, water pumps, oil pumps, turbo aftercoolers, turbo air ducts, starters and many other components are housed within the body of the locomotive making it awkward and difficult to remove them for maintenance and to reinstall them. These components are typically very heavy and cumbersome and their maintenance, repair, removal and/or replacement normally has been performed manually by hand heretofore. This manual method of operation has presented serious injury risks for the individual mechanics or repairmen servicing the device and has often required multiple personnel to remove or reinstall heavy components.

Accordingly, it is desirable to provide a lift mechanism which is capable of reaching into close, confined or constricted work spaces to assist the mechanic or repairman in the removal or replacement of heavy machinery components and to enable manpower reduction in performing such activities.

SUMMARY OF THE INVENTION

The present invention provides a machinery lift assembly comprising an L-shaped tubular support member having a first leg thereof connected to a beam at a pivot joint disposed intermediate the two ends of the beam. The pivot joint defines first and second cantilevered portions of the beam. In a preferred embodiment of our invention, a hydraulic cylinder is pivotably connected between the first cantilevered beam portion and the first leg of the support member to cause the beam to pivot relative to the support member upon activation of the cylinder. Of course, other mechanical, electrical or hydraulic moving devices may be employed as desired to produce this pivoting movement. The second cantilevered beam portion is fitted at its end with a device for attachment to a machinery component.

In the construction of our invention, the second leg of the support member extends in the same direction as the second cantilevered beam portion. The second leg of the support member may thereby be connected at its end to a suitable overhead crane such that the second cantilevered beam portion is free to reach into an enclosed space to enable connection to a machinery component for maintenance, repair, removal or replacement thereof.

BRIEF DESCRIPTION OF THE DRAWING

The features and advantages of the invention will become apparent from the following detailed description taken in connection with the accompanying drawing wherein.

DETAILED DESCRIPTION OF THE PREFERRED EMBODIMENT

Figure 1:
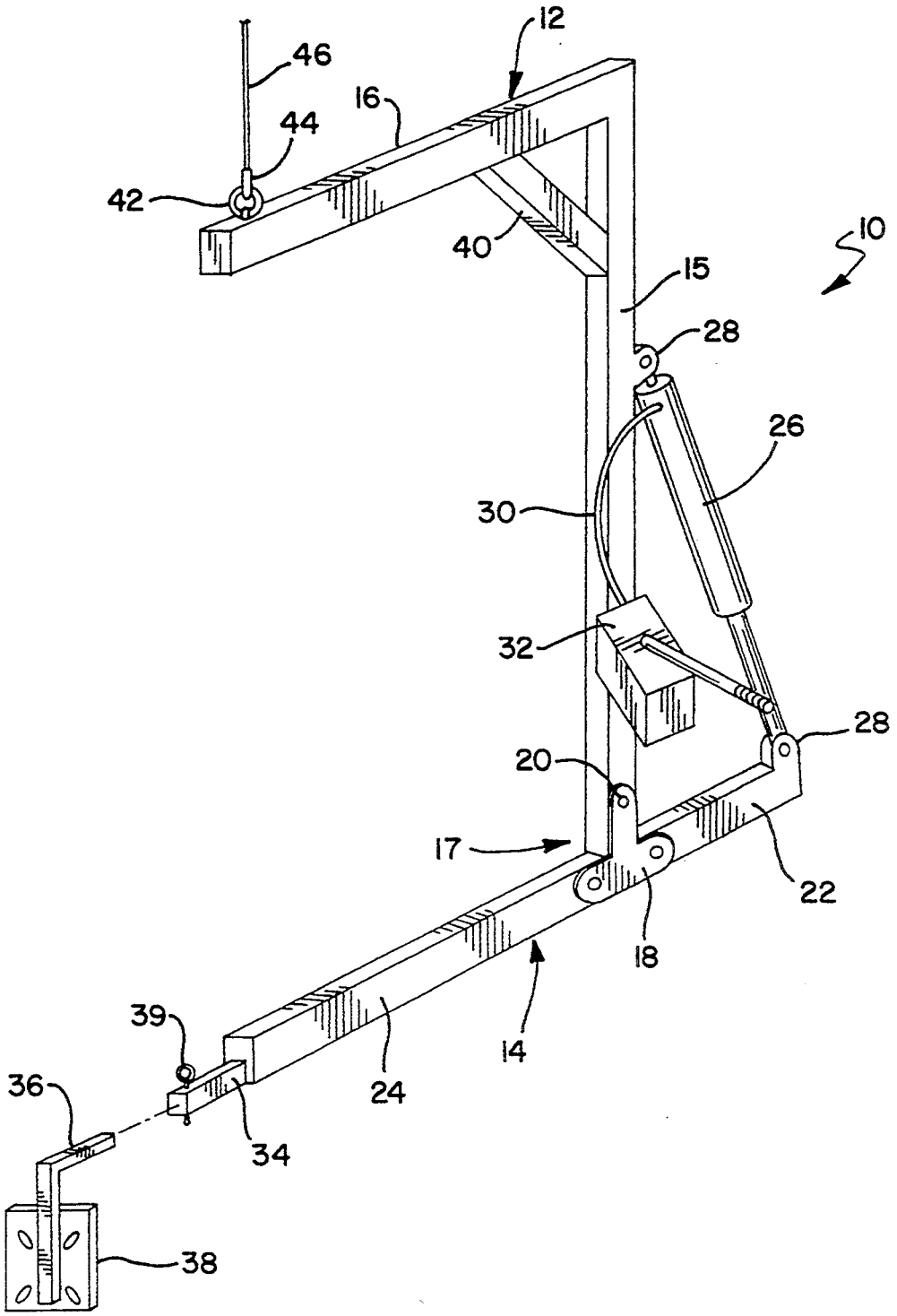
FIG. 1 is a perspective view of a machinery lift assembly constructed in accordance with the invention.

Referring now to the drawing of FIG. 1, there is illustrated a machinery lift assembly designated generally by the reference numeral 10 comprising a generally L-shaped support member 12 and a generally elongate beam 14. The support member 12 comprises a downwardly extending first leg 15 and a laterally extending second leg 16. The first leg 15 of the support member 12 is connected to the beam 14 by a pivot joint 17 constructed with a pair of T-shaped plates 18 (only one of which can be seen) bolted to the beam 14 intermediate the two ends of the beam 14. A suitable pin 20 extending through the plates and the lower end of the support member 12 provides the pivot joint 17.

The pivot joint 17 intersects the beam 14 to define a first cantilevered beam portion 22 and a second cantilevered beam, portion 24. The second beam portion 24 extends in the same generally direction as that of the second leg 16 of the support member 12 and is considerably longer than the first cantilevered beam portion 22. A hydraulic cylinder 26 is connected at a pair of pivot joints 28 between the distal end of the first beam portion 22 and the first leg 15 of the support member. The cylinder 26 is coupled by a suitable hose 30 to a hand-operated hydraulic pump 32 which is fastened to the side of the support member 12.

The distal end of the second beam portion 24 is provided with a hollow tubular tool receiver 34. The tool receiver 34 is configured to receive and support a bar 36 attached to a tool frame 38. A suitable pin 39 secures the bar 36 to the tool receiver 34 such that the tool frame 38 can be bolted to a machinery component and the lift assembly 10 can be used to support the component. The particular tool frame 38 illustrated in FIG. 1 is particularly useful in lifting water pumps of locomotives.

The legs 15 and 16 of the L-shaped support member 12 are reinforced at their juncture by a brace 40. The distal end of the leg 15 is provided with an eye bolt 42 for connection to a hook 44 and cable 46 from an overhead crane (not shown). Although the lift assembly 10 can be fabricated to virtually any scale, when it is used in the maintenance of locomotives, a preferred construction for the support member 12 and beam 14 is hollow 2 inch by 3 inch steel tubing. In such a construction the assembly will safely lift up to 400 pound components.

It can now be appreciated that the lift assembly 10 of the present invention provides a highly effective device for enabling maintenance, repair, removal and/or replacement of machinery components situated in enclosed, confined or constricted spaces because the cantilevered beam portion 24 is completely unobstructed by bracing or the like. Accordingly, the beam portion 24 can be inserted through relatively small openings and into small or confined spaces whereas other lift mechanisms cannot.

In locomotive maintenance the lift assembly 10 is particularly advantageous because an overhead crane alone cannot be used to remove components from the interior of the locomotive body. In operation, the assembly 10 is simply moved into position by properly positioning the overhead crane. Then the tool 38 is bolted to the component. Once the component has been disconnected from its mounting, the hydraulic cylinder 26 is activated to pivot beam portion 24 upwardly relative to the support member 12 and lift the component, whereupon the component can be extracted. When it is desired to reinstall the component, the hydraulic cylinder can readily be adjusted to accurately move the component into place.

While one form of tool 38 is illustrated in FIG. 1, it can be appreciated that tools of various kinds can be fabricated depending upon the configuration of the particular component which is to be lifted.

Figure 2:
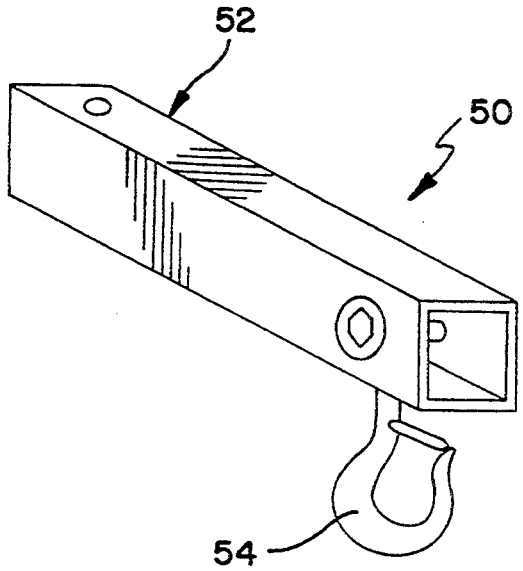
FIG. 2 is an embodiment of an accessory tool for use with the lift assembly of the present invention.
Figure 3:
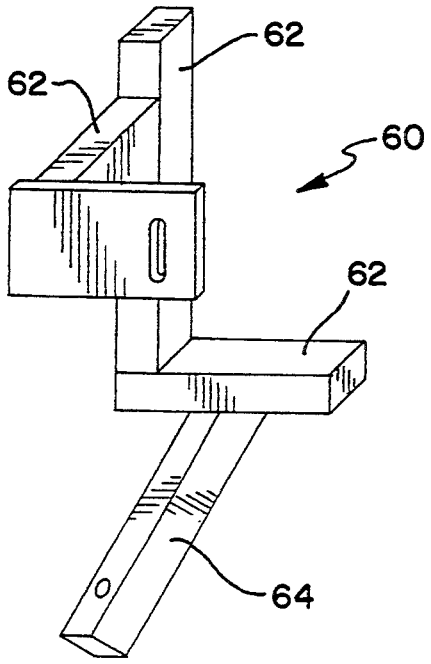
FIG. 3 is another embodiment of an accessory tool for use with the present lift assembly.

For example, FIG. 2 illustrates a tool 50 having a tongue 52 for insertion into the tool receiver 34 of the lift assembly 10. This tool has a suitable pivotable hook 54 for attachment as by a chain or cable to a variety of mechanical components. Also, FIG. 3 illustrates a tool 60 which is particularly useful in lifting locomotive governors. This tool 60 can be readily fabricated from 1"×2" steel tubing 62 with a square tongue 64 for insertion into the tool receiver 34.

Although the present invention has been described in connection with a particular embodiment thereof, it will be understood by those skilled in the art that many changes may be made without departing from the true spirit and scope of the present invention.

What is claimed is:

1. A machinery lift assembly comprising:

a generally elongate beam having a first rearwardly extending end and a second forwardly extending end;

a generally L-shaped support member having a first leg connected to the beam at a pivot joint disposed intermediate the first and second ends of the beam and defining a first rearwardly extending cantilevered portion and a second cantilevered portion of the beam extending in opposite directions from said pivot joint and a second leg of said support member extending from said first leg generally in the same direction as said forwardly extending end of said elongate beam; and means positioned between the first leg of said support member and said rearwardly extending portion of said beam for causing said beam to pivot about said pivot joint.

2. The assembly of claim 1 wherein said means for pivoting comprises a hydraulic cylinder.

3. The assembly of claim 1 wherein said second cantilevered portion of said beam is provided with a device for attachment to a machinery component.

4. The assembly of claim 3 wherein the second cantilevered portion of said beam is longer than said first cantilevered portion of said beam.

5. The assembly of claim 3 wherein said device comprises means for attachment to a locomotive governor.

6. The assembly of claim 3 wherein said device comprises means for attachment to a locomotive water pump.

7. The assembly of claim 3 wherein said device includes a lifting hook.

8. The assembly of claim 1 further comprising means connected to the second leg of the support member for suspending said assembly from an overhead crane.

* * * * *